US011066718B2

(12) United States Patent
Kamitani et al.

(10) Patent No.: US 11,066,718 B2
(45) Date of Patent: Jul. 20, 2021

(54) METHOD OF MANUFACTURING STAINLESS PIPE FOR OIL WELLS AND STAINLESS STEEL PIPE FOR OIL WELLS

(71) Applicant: NIPPON STEEL & SUMITOMO METAL CORPORATION, Tokyo (JP)

(72) Inventors: Hiroki Kamitani, Tokyo (JP); Taro Oe, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 332 days.

(21) Appl. No.: 15/774,608

(22) PCT Filed: Oct. 19, 2016

(86) PCT No.: PCT/JP2016/081010
§ 371 (c)(1),
(2) Date: May 9, 2018

(87) PCT Pub. No.: WO2017/122405
PCT Pub. Date: Jul. 20, 2017

(65) Prior Publication Data

US 2018/0320243 A1 Nov. 8, 2018

(30) Foreign Application Priority Data

Jan. 13, 2016 (JP) ..... JP2016-004751

(51) Int. Cl.
*C21D 9/08* (2006.01)
*C22C 38/54* (2006.01)
(Continued)

(52) U.S. Cl.
CPC ..... *C21D 9/08* (2013.01); *C21D 1/25* (2013.01); *C21D 6/004* (2013.01); *C21D 6/008* (2013.01);
(Continued)

(58) Field of Classification Search
CPC ..... C21D 9/08
See application file for complete search history.

(56) References Cited

FOREIGN PATENT DOCUMENTS

| | | |
|---|---|---|
| CN | 101981215 | 2/2011 |
| JP | 60-26645 | 2/1985 |

(Continued)

OTHER PUBLICATIONS

English machine translation of JP 2012-149317 A of Kimura published Aug. 9, 2012 (Year: 2012).*

(Continued)

*Primary Examiner* — Jophy S. Koshy
(74) *Attorney, Agent, or Firm* — Clark & Brody LP

(57) ABSTRACT

A method of manufacturing a stainless steel pipe includes preparing a hollow shell having a composition (mass %): up to 0.05% C; up to 1.0% Si; 0.01 to 1.0% Mn; up to 0.05% P; below 0.002% S; 0.001 to 0.1% Al; 16.0 to 18.0% Cr; 3.0 to 5.5% Ni; 1.8 to 3.0% Mo; 1.0 to 3.5% Cu; up to 0.05% N; up to 0.05% O; 0 to 0.3% Ti; 0 to 0.3% Nb; 0 to 0.3% V; 0 to 2.0% W; 0 to 0.01% Ca; 0 to 0.01% B; the balance Fe and impurities, holding the shell in a temperature range of 420 to 460° C. for 60 to 180 minutes; and then holding the shell in a temperature range of 550 to 600° C. for 5 to 300 minutes.

12 Claims, 1 Drawing Sheet

(51) Int. Cl.

| | |
|---|---|
| ***C21D 6/00*** | (2006.01) |
| ***C21D 8/10*** | (2006.01) |
| ***C22C 38/02*** | (2006.01) |
| ***C22C 38/04*** | (2006.01) |
| ***C22C 38/42*** | (2006.01) |
| ***C22C 38/44*** | (2006.01) |
| ***C22C 38/46*** | (2006.01) |
| ***C22C 38/00*** | (2006.01) |
| ***C21D 1/25*** | (2006.01) |
| ***C22C 38/06*** | (2006.01) |
| ***C22C 38/50*** | (2006.01) |
| *C21D 1/19* | (2006.01) |

(52) U.S. Cl.

CPC ..... *C21D 8/105* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/50* (2013.01); *C22C 38/54* (2013.01); *C21D 1/19* (2013.01); *C21D 8/10* (2013.01); *C21D 2211/001* (2013.01); *C21D 2211/005* (2013.01); *C21D 2211/008* (2013.01)

(56) References Cited

FOREIGN PATENT DOCUMENTS

| | | |
|---|---|---|
| JP | 2000-160300 | 6/2000 |
| JP | 2002-004009 | 1/2002 |
| JP | 2005-336595 | 12/2005 |
| JP | 2010-209042 | 9/2010 |
| JP | 2012-149317 | 8/2012 |
| JP | 5348354 | 11/2013 |
| JP | 2014-043595 | 3/2014 |
| JP | 2014-148699 | 8/2014 |
| WO | 2010/134498 | 11/2010 |
| WO | 2014/091756 | 6/2014 |

OTHER PUBLICATIONS

Qiujuan Guo, et aL, "Investigation on the Relationship of Reversed Austenite and Property with Tempering in $Cr_{13}Ni_4$ Forged Steel", Heavy Casting and Forging, No. 3, pp. 6, 7 and 18, May 2011.

Jun Yu et al., "Mechanical Engineering Materials", Metallurgical Industry Press, Aug. 2008, p. 100.

Sarma, "Measurement of Microstructure", Dec. 17, 2005, https://mme.iitm.ac.in/vsarma/mm3320/Measurement%20of%20Microstructure.pdf[Retrieved on Jul. 1, 2019].

* cited by examiner

METHOD OF MANUFACTURING STAINLESS PIPE FOR OIL WELLS AND STAINLESS STEEL PIPE FOR OIL WELLS

TECHNICAL FIELD

The present invention relates to a method of manufacturing a stainless steel pipe for oil wells and a stainless steel pipe for oil wells.

BACKGROUND ART

Oil wells and gas wells will be herein collectively referred to as "oil wells". "Stainless steel pipe for oil wells" includes a stainless steel pipe for oil wells and a stainless steel pipe for gas wells.

Stainless steel pipes for oil wells are used in high-temperature environments containing carbon dioxide gas and hydrogen sulfide gas. Conventionally, stainless steel pipes for oil wells used have been stainless steel pipes for oil wells made from 13% Cr steel, which has good carbon-dioxide-gas corrosion resistance.

In recent years, oil wells have become deeper and deeper and, consequently, demand has been growing for stainless steel pipes for oil wells with better strength and corrosion resistance than 13% Cr steel. Demand has also been growing for stainless steel pipes for oil wells with better toughness than 13% Cr steel that can be used in cold districts.

To meet these demands, stainless steel pipes for oil wells made from martensite-ferrite duplex steel have been developed. Japanese Patent No. 5348354, JP 2014-43595 A, and JP 2010-209402 A each disclose a stainless steel pipe for oil wells containing about 17% Cr (hereinafter sometimes simply referred to as "17% Cr steel pipe").

JP 2010-209402 A describes making crystal grains finer to achieve a toughness represented by an amount of absorbed energy in Charpy impact testing at −40° C. of 20 J or higher.

On the other hand, it is known that the toughness of a 17% Cr steel pipe may be instable depending on the wall thickness or metal structure of the steel pipe.

WO 2014/091756 and JP 2014-148699 A teach that the quality of steel may become instable due to variances in the metal structure before tempering.

WO 2014/091756, listed above, describes example on-line heat treatment equipment for seamless steel pipes including a quenching heating furnace, quenching equipment and a tempering heating furnace, where low-temperature cooling equipment is positioned between the quenching equipment and tempering heating furnace for cooling a steel pipe under heat treatment to 20° C. or lower.

JP 2014-148699 A, listed above, describes determining in advance whether a pipe body is made from a steel type with an Ms point below 200° C.; if this condition meets, after quenching, the steel pipe is left in a room-temperature environment until the difference between the temperature of the maximum-temperature portion and the temperature of the minimum-temperature portion in a cross section perpendicular to the pipe axis is smaller than 2.0° C. and then subjected to tempering; if the above-provided condition does not meet, the steel pipe is subjected to tempering without being left in a environment. This document indicates that the average Charpy impact value of the resulting steel pipe at −10° C. was 87.7 J and the standard deviation was 3.8 J.

DISCLOSURE OF THE INVENTION

To perform the method described in WO 2014/091756, it is necessary to introduce new equipment with high cooling capability. The method of JP 2014-148699 A suffers from production problems since it requires making temperatures along the pipe-axis direction of the pipe body uniform during the process of manufacture and determining whether the Ms point is below 200° C., which means an increased number of steps.

An object of the present invention is to provide a method of manufacturing a stainless steel pipe for oil wells with improved toughness in a stable manner, and a stainless steel pipe for oil wells with improved toughness stability.

A method of manufacturing a stainless steel pipe for oil wells according to an embodiment of the present invention includes: the step of preparing a hollow shell having a chemical composition of, in mass %: up to 0.05% C; up to 1.0% Si; 0.01 to 1.0% Mn; up to 0.05% P; below 0.002% S; 0.001 to 0.1% Al; 16.0 to 18.0% Cr; 3.0 to 5.5% Ni; 1.8 to 3.0% Mo; 1.0 to 3.5% Cu; up to 0.05% N; up to 0.05% O; 0 to 0.3% Ti; 0 to 0.3% Nb; 0 to 0.3% V; 0 to 2.0% W; 0 to 0.01% Ca; 0 to 0.01% B; and the balance Fe and impurities; a first step for holding the hollow shell in a temperature range of 420 to 460° C. for a holding time of 60 to 180 minutes; and a second step, after the first step, for holding the hollow shell in a temperature range of 550 to 600° C. for a holding time of 5 to 300 minutes.

A stainless steel pipe for oil wells according to an embodiment of the present invention has a chemical composition of, in mass %: up to 0.05% C; up to 1.0% Si; 0.01 to 1.0% Mn; up to 0.05% P; below 0.002% S; 0.001 to 0.1% Al; 16.0 to 18.0% Cr; 3.0 to 5.5% Ni; 1.8 to 3.0% Mo; 1.0 to 3.5% Cu; up to 0.05% N; up to 0.05% O; 0 to 0.3% Ti; 0 to 0.3% Nb; 0 to 0.3% V; 0 to 2.0% W; 0 to 0.01% Ca; 0 to 0.01% B; and the balance Fe and impurities, wherein an average of a volume fraction of retained austenite on an inner surface of the steel pipe, a volume fraction of retained austenite in a middle section as determined along a wall thickness of the steel pipe, and a volume fraction of retained austenite on an outer surface of the steel pipe is 15% or below, with a standard deviation of 1.0 or below.

The present invention provides a method of manufacturing a stainless steel pipe for oil wells with improved toughness in a stable manner, and a stainless steel pipe for oil wells with improved toughness stability.

EMBODIMENTS FOR CARRYING OUT THE INVENTION

Figure 1:
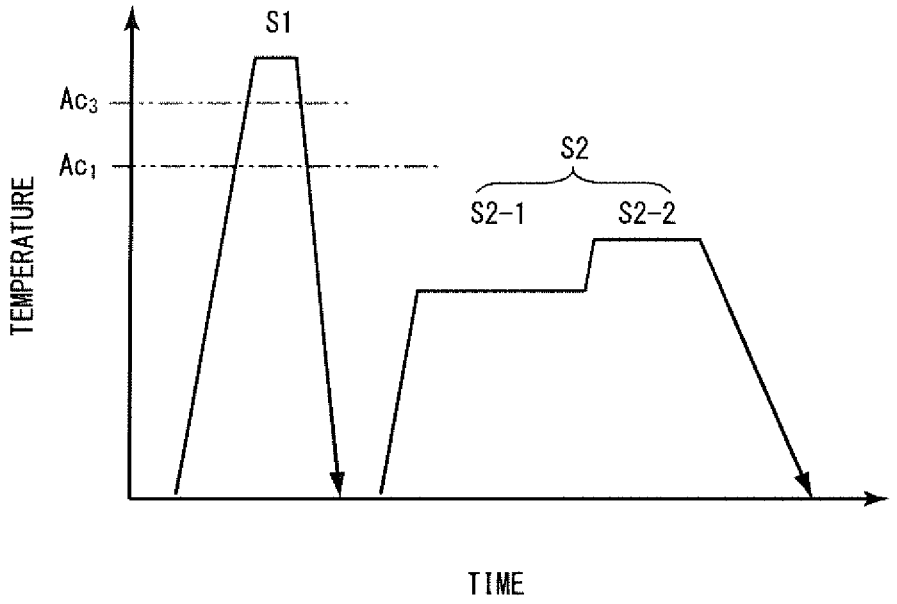
FIG. 1 shows a heat pattern of heat treatment in the method of manufacturing a stainless steel pipe for oil wells according to an embodiment of the present invention.

The present inventors did research to find a method for stabilizing the toughness of 17% Cr steel pipe. They obtained the following findings.

The metal structure of 17% Cr steel pipe is a martensite-ferrite duplex structure, as discussed above; in reality, the structure further contains retained austenite. A retained austenite reduces the yield strength of the steel. On the other hand, a small amount of retained austenite contributes to improvement in the toughness of the steel. If the volume fraction of retained austenite (hereinafter referred to as retained-austenite ratio) varies, the toughness of the steel also varies. By reducing variance in retained-austenite ratio along the wall-thickness direction of the pipe body, the stability of toughness may be improved.

More specifically, good toughness may be obtained in a stable manner if the average of the retained-austenite ratio of the inner surface, the retained-austenite ratio in a middle section as determined along the wall thickness, and the retained-austenite ratio of the outer surface is 15% or below, with a standard deviation of 1.0 or below.

The present inventors did further research focusing on the tempering step in the manufacturing process for 17% Cr steel pipe. They found that, to reduce variance along the wall-thickness direction of the pipe body without excessively increasing retained-austenite ratio, it would be effective to combine the step of holding the pipe in a relatively low temperature range for a predetermined period of time and the following step of holding the pipe in a temperature range near 600° C. for a predetermined period of time.

More specifically, they found that it would be effective to perform, in the stated order, a first step for holding the pipe in a temperature range of 420 to 460° C. for a holding time of 60 to 180 minutes, and a second step for holding the pipe in a temperature range of 550 to 600° C. for a holding time of 5 to 300 minutes. They also found that, within this method, the time of the second step may be adjusted to adjust retained-austenite ratio.

Stainless steel pipes for oil wells produced by this method had improved low-temperature toughness over conventional stainless steel pipes for oil wells.

It was also assumed that variance in the retained-austenite ratio along the wall-thickness direction of the pipe body may be reduced by simply prolonging the holding time for tempering. However, if tempering is performed for a prolonged period of time at high temperatures, the retained-austenite ratio of the steel pipe may increase even in a temperature range below the $Ac_1$ point, and thus the required yield strength may not be provided.

On the other hand, if the pipe is held in a temperature range of 400 to 500° C., 475° C. embrittlement, which is a type of embrittlement specific to high Cr steel, occurs. 475° C. embrittlement occurs as the metal structure is separated into two phases, i.e. an $\alpha$ phase with low Cr concentration and an $\alpha'$ phase with high Cr concentration. As such, a 17% Cr steel pipe with good toughness cannot be obtained by performing tempering for a prolonged period of time only in a low temperature range.

The $\alpha'$ phase can be made to dissolve by heating the pipe to near 600° C. That is, even a stainless steel pipe in which 475° C. embrittlement has occurred may be made to recover from brittleness by heating the pipe to near 600° C. Further, it is assumed that variance in the retained-austenite ratio may be reduced through a tempering process with such two heating steps transitioning from a low temperature range to a high temperature range.

A stainless steel pipe for oil wells according to an embodiment of the present invention will now be described in detail with reference to the drawings.

[Chemical Composition]

The stainless steel pipe for oil wells according to the present embodiment has the chemical composition described below. In the following description, "%" for the content of an element means a mass percentage.

C: up to 0.05%

Carbon (C) contributes to improvement in strength, but produces Cr carbides during tempering. Cr carbides reduce the corrosion resistance of the steel against hot carbon dioxide gas. In view of this, the lower the C content, the better. The C content should be not higher than 0.05%. The C content is preferably lower than 0.05%, and more preferably not higher than 0.03%, and still more preferably not higher than 0.01%.

Si: up to 1.0%

Silicon (Si) deoxidizes steel. However, if the Si content is too high, the hot workability of the steel decreases. Further, the amount of produced ferrite increases, which decreases yield strength. In view of this, the Si content should be not higher than 1.0%. The Si content is preferably not higher than 0.8%, and more preferably not higher than 0.5%, and still more preferably not higher than 0.4%. If the Si content is not lower than 0.05%, Si acts particularly effectively as a deoxidizer. However, even if the Si content is lower than 0.05%, Si deoxidizes the steel to some degree.

Mn: 0.01 to 1.0%

Manganese (Mn) deoxidizes and desulfurize steel, thereby improving hot workability. However, if the Mn content is too high, segregation can easily occur in the steel, which decreases toughness and the stress corrosion cracking resistance (hereinafter referred to as SCC resistance) in a high-temperature aqueous chloride solution. Further, Mn is an austenite-forming element. Thus, if the steel contains Ni and Cu, which are austenite-forming elements, an excessive Mn content increases retained-austenite ratio, which decreases yield strength. In view of this, the Mn content should be in a range of 0.01 to 1.0%. To specify a lower limit, the Mn content is preferably not lower than 0.03%, and more preferably not lower than 0.05%, and still more preferably not lower than 0.07%. To specify an upper limit, the Mn content is preferably not higher than 0.5%, and more preferably not higher than 0.2%, and still more preferably not higher than 0.14%.

P: up to 0.05%

Phosphor (P) is an impurity. P decreases sulfide stress cracking resistance (hereinafter referred to as SSC resistance) of the steel and SCC resistance in a high-temperature aqueous-chloride-solution environment. In view of this, the lower the P content, the better. The P content should be not higher than 0.05%. The P content is preferably lower than 0.05%, and more preferably not higher than 0.025%, and still more preferably not higher than 0.015%.

S: below 0.002%

Sulfur (S) is an impurity. S decreases the hot workability of the steel. The metal structure of the stainless steel pipe for oil wells according to the present embodiment may become a duplex structure containing ferrite and austenite during hot working. S decreases the hot workability of such a duplex structure. Further, S combines with Mn or the like to form inclusions. The inclusions work as initiation points for pitting or SCC, which decreases the corrosion resistance of the steel. In view of this, the lower than S content, the better. The S content should be lower than 0.002%. The S content is preferably not higher than 0.0015%, and more preferably not higher than 0.001%.

Al: 0.001 to 0.1%

Aluminum (Al) deoxidizes steel. However, if the Al content is too high, the amount of ferrite in the steel increases, which decreases the strength of the steel. Further, large amounts of alumina-based inclusions are produced in the steel, which decreases the toughness of the steel. In view of this, the Al content should be in a range of 0.001 to 0.1%. To specify a lower limit, the Al content is preferably higher than 0.001%, and more preferably not lower than 0.01%. To specify an upper limit, the Al content is preferably lower than 0.1%, and more preferably not higher than 0.06%. Al content as used herein means the content of acid-soluble Al (sol. Al).

Cr: 16.0 to 18.0%

Chromium (Cr) increases SCC resistance in a high-temperature aqueous-chloride-solution environment. However, since Cr is a ferrite-forming element, an excessive Cr content increases the amount of ferrite in the steel excessively, which decreases the yield strength of the steel. In view of this, the Cr content should be in a range of 16.0 to 18.0. To specify a lower limit, the Cr content is preferably higher than 16.0%, and more preferably 16.3%, and still more preferably 16.5%. To specify an upper limit, the Cr content is preferably lower than 18.0%, and more preferably 17.8%, and still more preferably 17.5%.

Ni: 3.0 to 5.5%

Nickel (Ni) is an austenite-forming element, which stabilizes austenite in high temperatures and increases the amount of martensite at room temperature. Thus, Ni increases the strength of the steel. Ni further increases the corrosion resistance in a high-temperature aqueous-chloride-solution environment. However, if the Ni content is too high, retained-austenite ratio can easily increase, making it difficult to obtain high strength in a stable manner, particularly in industrial production. In view of this, the Ni content should be in a range of 3.0 to 5.5%. To specify a lower limit, the Ni content is preferably higher than 3.0%, and more preferably not lower than 3.5%, and still more preferably not lower than 4.0%, and yet more preferably not lower than 4.2%. To specify an upper limit, the Ni content is preferably lower than 5.5%, and more preferably not higher than 5.2%, and still more preferably not higher than 4.9%

Mo: 1.8 to 3.0%

Molybdenum (Mo) improves SSC resistance. Further, Mo, when present together with Cr, increases the SCC resistance of the steel. However, since Mo is an ferrite-forming element, an excessive Mo content increases the amount of ferrite in the steel, which decreases the strength of the steel. In view of this, the Mo content should be in a range of 1.8 to 3.0%. To specify a lower limit, the Mo content is preferably higher than 1.8%, and more preferably not lower than 2.0%, and still more preferably not lower than 2.1%. To specify an upper limit, the Mo content is preferably lower than 3.0%, and more preferably not higher than 2.7%, and still more preferably not higher than 2.6%.

Cu: 1.0 to 3.5%

Copper (Cu) strengthens ferrite phase by virtue of age-precipitation, thereby increasing the strength of the steel. Cu further reduces the rate at which steel elutes in a high-temperature aqueous-chloride-solution environment, which increases the corrosion resistance of the steel. However, if the Cu content is too high, the hot workability and toughness of the steel decrease. In view of this, the Cu content should be in a range of 1.0 to 3.5%. To specify a lower limit, the Cu content is preferably higher than 1.0%, and more preferably not lower than 1.5%, and still more preferably not lower than 2.2%. To specify an upper limit, the Cu content is preferably lower than 3.5%, and more preferably not higher than 3.2%, and still more preferably not higher than 3.0%.

N: up to 0.05%

Nitrogen (N) increases the strength of steel. N further stabilizes austenite and increases pitting resistance. This effect can be achieved to some degree if a small amount of N is contained. On the other hand, if the N content is too high, large amounts of nitrides are produced in the steel, which decreases the toughness of the steel. Further, austenite tends to remain, which may decrease the strength of the steel. In view of this, the N content should be not higher than 0.05%. To specify a lower limit, the N content is preferably not lower than 0.002%, and more preferably not lower than 0.005%. To specify an upper limit, the N content is not higher than 0.03%, and more preferably not higher than 0.02%, and still more preferably not higher than 0.015%.

O: up to 0.05%

Oxygen (O) is an impurity. O decreases the toughness and corrosion resistance of the steel. In view of this, the lower the O content, the better. The O content should be not higher than 0.05%. The O content is preferably lower than 0.05%, and more preferably not higher than 0.01%, and still more preferably not higher than 0.005%.

The balance of the chemical composition of the stainless steel pipe for oil wells according to the present embodiment is Fe and impurities. Impurity as used here means an element originating from ore or scrap used as raw material for steel or an element that has entered from the environment or the like during the manufacturing process.

In the chemical composition of the stainless steel pipe for oil wells according to the present embodiment, some Fe may be replaced by one or more elements selected from the group consisting of Ti, Nb, V, W, Ca and B. Ti, Nb, V, W, Ca and B are optional elements. That is, the chemical composition of the stainless steel pipe for oil wells according to the present embodiment may contain only one or none of Ti, Nb, V, W, Ca and B.

Ti: 0 to 0.3%

Nb: 0 to 0.3%

V: 0 to 0.3%

Each of titanium (Ti), niobium (Nb) and vanadium (V) forms carbides and increases the strength and toughness of the steel. They further fix C to prevent production of Cr carbides. This improves the pitting resistance and SCC resistance of the steel. These effects can be achieved to some degree if small amounts of these elements are contained. On the other hand, if the contents of these elements are too high, carbides become coarse, which decreases the toughness and corrosion resistance of the steel. In view of this, each of the Ti content, Nb content and V content should be in a range of 0 to 0.3%. To specify lower limits, each of the Ti content, Nb content and V content is preferably not lower than 0.005%. This achieves the above-described effects in a conspicuous manner. To specify upper limits, each of the Ti content, Nb content and V content is preferably lower than 0.3%.

W: 0 to 2.0%

Tungsten (W) increases SCC resistance in high-temperature environments. This effect can be achieved to some degree if a small amount of W is contained. On the other hand, if the element content is too high, saturation is reached in terms of this effect. In view of this, the W content should be in a range of 0 to 2.0%. To specify a lower limit, the W content is preferably not lower than 0.01%. This achieves the above-described effect in a conspicuous manner.

Ca: 0 to 0.01%

B: 0 to 0.01%

Each of calcium (Ca) and boron (B) prevents production of flaws or defects during hot working. This effect can be achieved to some degree if small amounts of these elements are contained. On the other hand, if the Ca content is too high, this increases inclusions in the steel, which decreases the toughness and corrosion resistance of the steel. If the B content is too high, carboborides of Cr precipitate on crystal grain boundaries, which decreases the toughness of the steel. In view of this, each of the Ca content and B content is in a range of 0 to 0.01%. To specify lower limits, each of the Ca content and B content is preferably not lower than 0.0002%. This achieves the above-described effects in a conspicuous manner. To specify upper limits, each of the Ca content and B content is preferably lower than 0.01%, and more preferably not higher than 0.005%.

[Metal Structure]

In the stainless steel pipe for oil wells according to the present embodiment, the average of the retained-austenite ratio of the inner surface of the steel pipe, the retained-austenite ratio in a middle section of the steel pipe as determined along the wall thickness, and the retained-austenite ratio of the outer surface of the steel pipe is 15% or below, with a standard deviation of 1.0 or below.

A small amount of retained austenite significantly improves the toughness of the steel. However, if the retained-austenite ratio is too high, the yield strength of the steel significantly decreases.

Typically, the retained-austenite ratio of a steel pipe is evaluated based on a test specimen taken from a section of the steel pipe near the middle as determined along the wall thickness. However, a distribution of retained-austenite ratio may be created along the wall-thickness direction of the steel pipe depending on the temperature distribution during the process of heat treatment. More specifically, the surfaces of the steel pipe (i.e. inner and outer surfaces) can easily be cooled and thus can easily be transformed to martensite. On the other hand, a section of the steel pipe in the middle along the wall thickness cannot easily be cooled and thus retained-austenite ratio tends to be high.

Even for substantially the same retained-austenite ratio evaluated based on a section near the middle along the wall thickness, good toughness cannot be obtained in a stable manner if variance along the wall-thickness direction of the pipe body is large. This is presumably because, even if the overall retained-austenite ratio is high, a fracture is initiated in any local section where no retained austenite is present, and advances therefrom.

In the context of the present embodiment, the amount of retained austenite is evaluated based on the average of the retained-austenite ratio of the inner surface of the steel pipe, the retained-austenite ratio in a middle section of the steel pipe as determined along the wall thickness, and the retained-austenite ratio of the outer surface of the steel pipe (hereinafter referred to as average retained-austenite ratio) and the standard deviation thereof (hereinafter referred to as standard deviation of retained-austenite ratio).

If the average retained-austenite ratio is above 15%, the required yield strength cannot be provided. In view of this, the average retained-austenite ratio should be not higher than 15%. To specify an upper limit, the average retained-austenite ratio is preferably not higher than 10%, and more preferably not higher than 8%. On the other hand, to improve toughness, higher retained-austenite ratios are preferred. To specify a lower limit, the average retained-austenite ratio is preferably not lower than 1.5%, and more preferably not lower than 2.5%.

If the standard deviation of retained-austenite ratio is above 1.0, toughness becomes instable. In view of this, the standard deviation of retained-austenite ratio should be not higher than 1.0. The standard deviation of retained-austenite ratio is preferably not higher than 0.9.

Specifically, the average retained-austenite ratio and standard deviation of retained-austenite ratio are determined as follows.

Test specimens are taken from the inner surface of a stainless steel pipe for oil wells, a middle section thereof along the wall thickness, and the outer surface thereof. The size of each test specimen is 15 mm circumferentially by 15 mm along the pipe-axis direction by 2 mm along the wall-thickness direction. For each test specimen, the retained-austenite ratio is determined by X-ray diffraction. The integral intensity of each of the (200) plane and (211) plane of ferrite phase and the (200) plane, (220) plane and (311) plane of retained austenite is measured. For each combination of a plane of the α phase and a plane of the γ phase (2×3=6 combinations), the volume fraction Vγ is calculated using equation (A), given below. The average of the volume fractions Vγ for the six combinations is treated as the retained-austenite ratio of the test specimen.

$$V\gamma=100/(1+(I\alpha\times R\gamma)/(I\gamma\times R\alpha)) \quad \text{(A).}$$

"Iα" indicates the integral intensity of the α phase, "Rα" indicates a crystallographical theoretical calculation value for the α phase, "Iγ" indicates the integral intensity of the γ phase, and "Rγ" indicates a crystallographical theoretical calculation value for the γ phase.

The average retained-austenite ratio $V\gamma_{AVE}$ is calculated using the following equation, (B):

$$V\gamma_{AVE}=(V\gamma_I+V\gamma_M+V\gamma_O)/3 \quad \text{(B).}$$

"$V\gamma_I$" indicates the retained-austenite ratio of a test specimen taken from the inner surface, "$V\gamma_M$" indicates the retained-austenite ratio of a test specimen taken from a middle section along the wall thickness, and "$V\gamma_O$" indicates the retained-austenite ratio of a test specimen taken from the outer surface.

The standard deviation σ(γ) of retained-austenite ratio is calculated using equation (C), given below. The standard deviation is a sample standard deviation.

$$o(\gamma)=(((V\gamma_I-V\gamma_{AVE})^2+(V\gamma_M-V\gamma_{AVE})^2+(V\gamma_O-V\gamma_{AVE})^2)/2)^{1/2} \quad \text{(C).}$$

The metal structure of the stainless steel pipe for oil wells according to the present embodiment may include ferrite phase. Ferrite phase improves the SCC resistance of the steel. However, if the volume fraction of ferrite phase is too high, the required yield strength cannot be provided. The volume fraction of ferrite phase is preferably not lower than 10% and lower than 60%. To specify a lower limit, the volume fraction of ferrite phase is more preferably higher than 10%, and still more preferably not lower than 12%, and yet more preferably not lower than 14%. To specify an upper limit, the volume fraction of ferrite phase is more preferably not higher than 48%, and still more preferably not higher than 45%, and yet more preferably not higher than 40%.

Specifically, the volume fraction of ferrite phase is determined by the following method. A test specimen is taken from a section of the pipe body near the middle along the wall thickness. The surface perpendicular to the pipe-body-axis direction is polished. The polished surface is etched by a mixture of aqua regia and glycerin. The area fraction of ferrite phase in the etched surface is measured by optical microscopy (by an observation magnification of 100 times), using point counting in accordance with ASTM E562-11. The measured area fraction is treated as the volume fraction of ferrite phase.

The remainder of the metal structure of the stainless steel pipe for oil wells according to the present embodiment is mainly martensite. "Martensite" includes tempered martensite. If the volume fraction of martensite is too low, the required yield strength cannot be provided. The volume fraction of martensite is preferably not lower than 40%, and more preferably not lower than 48%, and still more preferably not lower than 52%. The volume fraction of martensite may be calculated by subtracting the volume fraction of ferrite and the volume fraction of retained austenite from 100%.

In addition to retained austenite, ferrite phase and martensite, the metal structure of the stainless steel pipe for oil wells according to the present embodiment may include carbides, nitrides, borides, precipitates of Cu phase or the like and/or inclusions.

[Manufacture Method]

A method of manufacturing the stainless steel pipe for oil wells according to an embodiment of the present invention will now be described.

First, a hollow shell having the above-described chemical composition is prepared. A method of manufacturing a seamless steel pipe as a hollow shell from a material having the above-described chemical composition will be described as an example.

The material may be, for example, a cast piece produced by continuous casting (including round CC). The material may be a steel piece produced by producing an ingot by ingot-making and subjecting the ingot to hot working, or may be a steel piece produced from a cast piece.

The material is loaded into a heating furnace or soaking furnace and heated. Subsequently, the heated material is subjected to hot working to produce a hollow shell. For example, the hot working may be the Mannesmann method. More specifically, the material is subjected to piercing/rolling by a piercing mill to produce a hollow shell. Subsequently, a mandrel mill or sizing mill may be used to further roll the hollow shell. The hot working may be hot extrusion or hot forging.

At the time of the hot working, the reduction of area of the material at material temperatures of 850 to 1250° C. is preferably not lower than 50%. If hot working is performed in this manner, a structure containing a martensite and a ferrite phase extending in the rolling direction in an elongated manner are formed in a surface portion of the steel. Ferrite is more likely to contain Cr or the like than martensite, and thus effectively contributes to prevention of advancement of SCC in high temperatures. With a ferrite phase extending in the rolling direction in an elongated manner, even if SCC is produced on the surface at high temperatures, cracks are highly likely to reach the ferrite phase while advancing. This improves the SCC resistance at high temperatures.

The hollow shell after hot working is cooled. To cool the hollow shell, it may be left to cool or may be water cooled. In the former case, if the chemical composition falls within the ranges of the present embodiment, martensite transformation occurs, provided that the hollow shell is cooled to a temperature that is not higher than the Ms point.

FIG. 1 shows a heat pattern of heat treatment in the method of manufacturing a stainless steel pipe for oil wells according to the present embodiment. According to the present embodiment, the heat treatment is performed by performing quenching (step S1) and tempering (step S2).

Quenching is performed where the hollow shell is reheated to a temperature that is not lower than the $Ac_3$ point and cooled (step S1). The heating temperature is preferably ($Ac_3$ point+50° C.) to 1100° C. The hollow shell is held at the heating temperature for a holding time of 30 minutes, for example. The cooling after heating is preferably water cooling such as dipping or spraying. To ensure a high yield strength in a stable manner, the hollow shell is preferably cooled until its surface temperature becomes 60° C. or lower. The temperature at which the cooling is stopped is more preferably not higher than 45° C., and still more preferably not higher than 30° C.

The quenching (step S1) is an optional step. As discussed above, if the chemical composition falls within the ranges of the present embodiment, martensite transformation occurs during the cooling after hot working. Thus, the tempering (step S2) may be performed after hot working without performing the quenching (step S1). If the quenching (step S1) is performed, a higher yield strength can be obtained.

The hollow shell is tempered (step S2). According to the present embodiment, the tempering is performed by performing, in the stated order, a first step (step S2-1) in which the hollow shell is held at a temperature of 420 to 460° C. for a holding time of 60 to 180 minutes, and a second step (step S2-2) in which the hollow shell is held at a temperature of 550 to 600° C. for a holding time of 5 to 300 minutes.

The holding temperature for the first step is 420 to 460° C. If the holding temperature is lower than 420° C., the effect of making the metal structure uniform cannot be achieved to a sufficient degree. If the holding temperature is higher than 460° C., retained-austenite ratio gradually increases, and thus the holding cannot be done for a long time. To specify a lower limit, the holding temperature for the first step is preferably not lower than 430° C. To specify an upper limit, the holding temperature for the first step is preferably not higher than 455° C.

The holding time for the first step is 60 to 180 minutes. If the holding time is shorter than 60 minutes, the effect of making the metal structure uniform cannot be achieved to a sufficient degree. If the holding time is longer than 180 minutes, saturation is reached in terms of the effect, which is disadvantageous to productivity. To specify a lower limit, the holding time for the first step is preferably not shorter than 100 minutes, and more preferably not shorter than 110 minutes. To specify an upper limit, the holding time for the first step is preferably not longer than 130 minutes, and more preferably not longer than 125 minutes.

The holding temperature for the second step is 550 to 600° C. If the holding temperature is lower than 550° C., the effect of recovering from 475° C. embrittlement cannot be achieved to a sufficient degree. If the holding temperature is higher than 600° C., it is difficult to provide the required yield strength. This is presumably because retained-austenite ratio rapidly increases. To specify a lower limit, the holding temperature for the second step is preferably not lower than 555° C. To specify an upper limit, the holding temperature for the second step is preferably not higher than 580° C.

The holding time for the second step is 5 to 300 minutes. If the holding time is shorter than 5 minutes, the effect of recovering from 475° C. embrittlement cannot be achieved to a sufficient degree. If the holding time is longer than 300 minutes, saturation is reached in terms of the effect, which is disadvantageous to productivity. To specify a lower limit, the holding time for the second step is preferably not shorter than 10 minutes, and more preferably not shorter than 60 minutes, and still more preferably not shorter than 120 minutes. To specify an upper limit, the holding time for the second step is preferably not longer than 240 minutes.

The stainless steel pipe for oil wells according to an embodiment of the present invention and the method of manufacturing it have been described. The present embodiment will provide a stainless steel pipe for oil wells with good toughness stability.

The stainless steel pipe for oil wells according to the present embodiment preferably has a yield strength not lower than 125 ksi (861 MPa).

In the stainless steel pipe for oil wells according to the present embodiment, preferably, the average amount of absorbed energy in Charpy impact testing at −10° C. is not smaller than 150 J, and the standard deviation is not larger than 15 J. The average amount of absorbed energy in Charpy impact testing at −10° C. is more preferably not smaller than 200 J. The standard deviation of absorbed energy in Charpy impact testing at −10° C. is more preferably not larger than 10 J.

In the stainless steel pipe for oil wells according to the present embodiment, the average amount of absorbed energy in Charpy impact testing at −60° C. is preferably not smaller than 50 J.

The stainless steel pipe for oil wells according to the present embodiment and the method of manufacture it are particularly suitable for steel pipes (hollow shells) with a wall thickness of 18 mm or more. While a small wall thickness facilitates obtaining a structure that is uniform along the wall-thickness direction and stabilizing performance, the present embodiment will provide a good performance in a stable manner even in a steel pipe with a relatively large wall thickness of 18 mm or larger.

The embodiments of the present invention have been described. The above-described embodiments are merely examples for carrying out the present invention. Thus, the present invention is not limited to the above-described embodiments, and the above-described embodiments may be modified as appropriate without departing from the spirit of the invention.

EXAMPLES

The present invention will be more specifically described below using Examples. The present invention is not limited to these Examples.

Example 1

Steels labeled Marks A to E having the chemical compositions shown in Table 1 were smelted, and cast pieces were produced by continuous casting. "-" in Table 1 indicates that the content of the relevant element is at a impurity level.

TABLE 1

| Mark | Chemical composition (in mass %, balance being Fe and impurities) | | | | | | | | | | | | | | | | | |
|---|---|---|---|---|---|---|---|---|---|---|---|---|---|---|---|---|---|---|
| | C | Si | Mn | P | S | Cu | Cr | Ni | Mo | Ti | V | Nb | Al | B | Ca | W | O | N |
| A | 0.010 | 0.30 | 0.100 | 0.010 | 0.0005 | 2.47 | 16.78 | 4.73 | 2.50 | 0.006 | 0.05 | — | 0.036 | 0.0002 | 0.0018 | — | 0.0016 | 0.0116 |
| B | 0.011 | 0.26 | 0.100 | 0.012 | 0.0005 | 2.45 | 16.79 | 4.67 | 2.49 | 0.008 | 0.06 | — | 0.036 | 0.0002 | 0.0020 | — | 0.0018 | 0.0120 |
| C | 0.010 | 0.31 | 0.100 | 0.010 | 0.0005 | 2.47 | 16.76 | 4.74 | 2.50 | 0.006 | 0.05 | — | 0.036 | 0.0002 | 0.0016 | — | 0.0014 | 0.0100 |
| D | 0.010 | 0.31 | 0.100 | 0.010 | 0.0005 | 2.47 | 16.76 | 4.74 | 2.50 | 0.007 | 0.05 | — | 0.037 | 0.0002 | 0.0016 | — | 0.0015 | 0.0099 |
| E | 0.011 | 0.24 | 0.120 | 0.012 | 0.0005 | 2.44 | 16.86 | 4.85 | 2.46 | 0.005 | 0.05 | — | 0.034 | 0.0002 | 0.0013 | — | 0.0023 | 0.0100 |

Each cast piece was rolled by a blooming mill to produce a billet. Each billet was subjected to hot working to produce a hollow shell with an outer diameter of 193.7 mm and a wall thickness of 19.05 mm. After hot rolling, the hollow shell was left to cool to room temperature.

Each hollow shell was subjected to heat treatment under the conditions shown in Table 2 to produce stainless steel pipes for oil wells, labeled Test Nos. 1 to 13. The first step of the tempering was not performed on the stainless steel pipes for oil wells labeled Test Nos. 11 to 13. For every pipe, the cooling of the quenching was water cooling, and the cooling after the second step of the tempering was leaving the pipe to cool.

TABLE 2

| Test No. | Mark | Quenching | | Tempering | | | |
|---|---|---|---|---|---|---|---|
| | | | | first step | | second step | |
| | | temp. (° C.) | holding time (min) | temp. (° C.) | holding time (min) | temp. (° C.) | holding time (min) |
| 1 | A | 950 | 30 | 450 | 120 | 560 | 10 |
| 2 | A | 950 | 30 | 450 | 120 | 560 | 30 |
| 3 | A | 950 | 30 | 450 | 120 | 560 | 60 |
| 4 | A | 950 | 30 | 450 | 120 | 560 | 120 |
| 5 | A | 950 | 30 | 450 | 120 | 560 | 240 |
| 6 | B | 950 | 30 | 450 | 120 | 560 | 10 |
| 7 | B | 950 | 30 | 450 | 120 | 560 | 30 |
| 8 | B | 950 | 30 | 450 | 120 | 560 | 60 |
| 9 | B | 950 | 30 | 450 | 120 | 560 | 120 |
| 10 | B | 950 | 30 | 450 | 120 | 560 | 240 |
| 11 | C | 950 | 30 | | | 560 | 60 |
| 12 | D | 950 | 30 | | | 560 | 60 |
| 13 | E | 950 | 30 | | | 560 | 60 |

A round-bar specimen in accordance with the API standards (φ 12.7 mm×GL 50.8 mm) was taken from each stainless steel pipe for oil wells. The direction of pull of the round-bar specimen was the pipe-axis direction. The round-bar specimen taken was used to conduct a tensile test at room temperature (25° C.) in accordance with the API standards to calculate the yield strength.

For each stainless steel pipe for oil wells, the average retained-austenite ratio and the standard deviation of retained-austenite ratio were calculated based on the methods described in the Embodiments. Separately, the methods and observation by optical microscopy described in the Embodiments were performed on each stainless steel pipe, and it turned out that each steel pipe had a structure composed of a main phase (a half of the field of observation or more) of martensite and, in addition, ferrite and retained austenite.

The yield strengths, average retained-austenite ratio and standard deviation of retained-austenite ratio of the stainless steel pipes for oil wells are shown in Table 3.

TABLE 3

| Test No. | Yield strength (ksi) | Retained-austenite ratio | | | | |
|---|---|---|---|---|---|---|
| | | outer surface (%) | middle (%) | inner surface (%) | average (%) | standard deviation |
| 1 | 139.5 | 1.97 | 2.81 | 2.49 | 2.42 | 0.42 |
| 2 | 136.9 | 2.22 | 3.15 | 3.16 | 2.84 | 0.54 |
| 3 | 135.1 | 3.26 | 4.07 | 3.46 | 3.60 | 0.42 |
| 4 | 134.0 | 3.23 | 4.41 | 3.89 | 3.84 | 0.59 |
| 5 | 130.9 | 5.24 | 6.35 | 5.77 | 5.79 | 0.56 |
| 6 | 140.9 | 1.64 | 2.74 | 1.41 | 1.93 | 0.71 |
| 7 | 139.9 | 1.94 | 2.71 | 2.43 | 2.36 | 0.39 |

TABLE 3-continued

| Test No. | Yield strength (ksi) | Retained-austenite ratio: outer surface (%) | middle (%) | inner surface (%) | average (%) | standard deviation |
|---|---|---|---|---|---|---|
| 8 | 133.7 | 2.39 | 3.50 | 2.57 | 2.82 | 0.60 |
| 9 | 133.7 | 3.49 | 5.08 | 4.64 | 4.40 | 0.82 |
| 10 | 131.3 | 5.00 | 5.76 | 4.70 | 5.15 | 0.55 |
| 11 | 131.3 | 2.61 | 6.22 | 4.65 | 4.49 | 1.81 |
| 12 | 137.5 | 5.01 | 8.26 | 3.14 | 5.47 | 2.59 |
| 13 | 133.8 | 6.08 | 11.65 | 6.32 | 8.02 | 3.15 |

As shown in Table 3, in the stainless steel pipes for oil wells labeled Test Nos. 1 to 10, the average retained-austenite ratio was not higher than 15%, and the standard deviation was not higher than 1.0. These steel pipes also exhibited yield strengths not lower than 125 ksi (862 MPa).

On the other hand, in the stainless steel pipes for oil wells labeled Test Nos. 11 to 13, the average retained-austenite ratio was not higher than 15% but the standard deviation was higher than 1.0. This is presumably because the first step of the tempering was not performed on these steel pipes.

A full-size test specimen (along the L direction) in accordance with ASTM E23 was taken from each stainless steel pipe for oil wells. The test specimen taken was used to conduct Charpy impact testing at −10° C. and −60° C. Charpy impact testing was conducted for three test specimens for each stainless steel pipes for oil wells and each test temperature to calculate the average and standard deviation. The standard deviation was a sample standard deviation.

The results of the Charpy impact tests are shown in Table 4. The columns under "$E_{-10}$" in Table 4 have absorbed energy values from the Charpy impact tests at −10° C. The columns under "$E_{-60}$" have absorbed energy values from the Charpy impact tests at −60° C. "-" indicates that the relevant test was not conducted.

TABLE 4

| Test No. | Charpy impact test: $E_{-10}$(J) 1 | 2 | 3 | average | standard deviation | $E_{-60}$(J) 1 | 2 | 3 | average |
|---|---|---|---|---|---|---|---|---|---|
| 1 | 214 | 190 | 211 | 205 | 13.08 | 23 | 15 | 27 | 22 |
| 2 | 215 | 197 | 211 | 208 | 9.45 | 55 | 35 | 16 | 35 |
| 3 | 222 | 215 | 222 | 220 | 4.04 | 56 | 54 | 45 | 52 |
| 4 | 220 | 232 | 226 | 226 | 6.00 | 80 | 62 | 72 | 71 |
| 5 | 239 | 230 | 241 | 237 | 5.86 | 104 | 105 | 178 | 129 |
| 6 | 201 | 219 | 207 | 209 | 9.17 | 20 | 29 | 26 | 25 |
| 7 | 213 | 222 | 218 | 218 | 4.51 | 38 | 29 | 31 | 33 |
| 8 | 218 | 215 | 212 | 215 | 3.00 | 53 | 198 | 74 | 108 |
| 9 | 221 | 227 | 204 | 217 | 11.93 | 39 | 72 | 64 | 58 |
| 10 | 219 | 232 | 205 | 219 | 13.50 | 53 | 106 | 62 | 74 |
| 11 | 97 | 87 | 166 | 117 | 43.02 | 26 | 24 | 67 | 39 |
| 12 | 195 | 160 | 233 | 196 | 36.51 | — | — | — | — |
| 13 | 110 | 188 | 201 | 166 | 49.22 | — | — | — | — |

As shown in Table 4, in the stainless steel pipes for oil wells labeled Test Nos. 1 to 10, the average values from Charpy impact tests at −10° C. were not lower than 150 J, and the standard deviation was not higher than 15 J.

In the stainless steel pipe for oil wells labeled Test No. 11, the average value from the Charpy impact tests at −10° C. was below 150 J, and the standard deviation was higher than 15 J. In the stainless steel pipes for oil wells labeled Test Nos. 12 and 13, the average value from the Charpy impact tests at −10° C. was not lower than 150 J, but the standard deviation was higher than 15 J. This is presumably because the first step of the tempering was not performed on these steel pipes.

Further, in the stainless steel pipes for oil wells labeled Test Nos. 3 to 5 and 8 to 10, where the holding time for the second step was not shorter than 60 minutes, the average value from the Charpy impact tests at −60° C. was not lower than 50 J.

Figure 2:
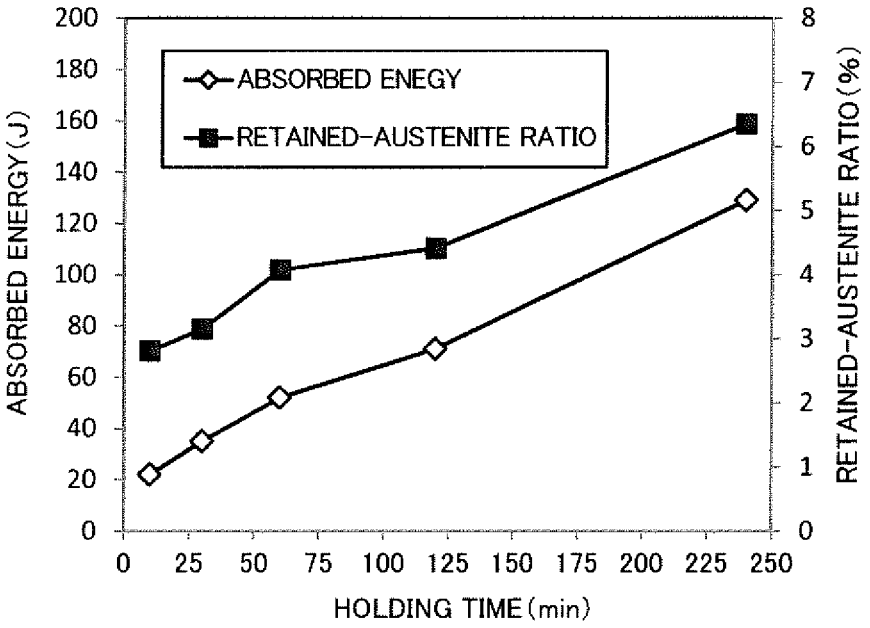
FIG. 2 shows a graph of the relationship between the holding time of the second step, retained-austenite ratio, and absorbed energy in Charpy impact testing at −60° C.

FIG. 2 shows a graph of the relationship between the holding time of the second step, retained-austenite ratio, and absorbed energy in Charpy impact testing at −60° C. FIG. 2 was created based on the stainless steel pipes for oil wells labeled Test Nos. 1 to 5. The retained-austenite ratio is the value from a middle section as determined along the wall thickness.

As shown in Table 2, it was found that the holding time of the second step was adjusted to control the retained-austenite ratio. Further, it was found that fine retained austenite was distributed uniformly to provide good low-temperature toughness.

Example 2

The steel labeled Mark F with the chemical composition shown in Table 5 was smelted, and cast pieces were produced by continuous casting.

TABLE 5

| Mark | Chemical composition (in mass %, balance being Fe and impurities): C | Si | Mn | P | S | Cu | Cr | Ni | Mo | Ti | V | Nb | Al | B | Ca | W | O | N |
|---|---|---|---|---|---|---|---|---|---|---|---|---|---|---|---|---|---|---|
| F | 0.011 | 0.26 | 0.120 | 0.012 | 0.0005 | 2.46 | 17.10 | 4.91 | 2.47 | 0.004 | 0.05 | 0.001 | 0.034 | 0.0001 | 0.0014 | 1.5 | 0.0021 | 0.0106 |

These cast pieces were rolled by the blooming mill to produce billets. Each billet was subjected to hot working to produce a hollow shell with an outer diameter of 285.75 mm and a wall thickness of 33.65 min. After hot rolling, the hollow shell was left to cool to room temperature.

The hollow shells were subjected to heat treatment under the conditions shown in Table 6 to produce stainless steel pipes for oil wells, labeled Test Nos. 101 to 113. The second step of the tempering was not performed on the stainless steel pipe for oil wells labeled Test No. 101. The first step of the tempering was not performed on the stainless steel pipe for oil wells labeled Test No. 109. For every pipe, the cooling of the quenching was water cooling, and the cooling after the second step of the quenching was leaving the pipe to cool.

TABLE 6

| | Quenching | | Tempering | | | |
|---|---|---|---|---|---|---|
| | | | first step | | second step | |
| Test No. | temp. (° C.) | holding time (min) | temp. (° C.) | holding time (min) | temp. (° C.) | holding time (min) |
| 101 | 950 | 30 | 450 | 120 | — | — |
| 102 | 950 | 30 | 450 | 120 | 560 | 5 |
| 103 | 950 | 30 | 450 | 120 | 560 | 10 |
| 104 | 950 | 30 | 450 | 120 | 560 | 30 |
| 105 | 950 | 30 | 450 | 120 | 560 | 60 |
| 106 | 950 | 30 | 450 | 120 | 560 | 120 |
| 107 | 950 | 30 | 450 | 120 | 560 | 240 |
| 108 | 950 | 30 | 450 | 120 | 560 | 300 |
| 109 | 950 | 30 | — | — | 600 | 30 |
| 110 | 950 | 30 | 400 | 120 | 560 | 60 |
| 111 | 950 | 30 | 500 | 120 | 560 | 60 |
| 112 | 950 | 30 | 450 | 120 | 500 | 60 |
| 113 | 950 | 30 | 450 | 120 | 650 | 60 |

For each stainless steel pipe for oil wells, the same tensile test as for Example 1 was conducted to calculate yield strength and tensile strength. Further, for each stainless steel pipe for oil wells, the same Charpy impact test as for Example 1 was conducted.

The yield strength and tensile strength of each stainless steel pipe for oil wells and the results of Charpy impact testing are shown in Table 7.

TABLE 7

| | | | Charpy impact test | | | | | |
|---|---|---|---|---|---|---|---|---|
| | | | $E_{-10}$ (J) | | | | | |
| Test No. | YS | TS | 1 | 2 | 3 | average | standard deviation | $E_{-60}$ (J) average |
| 101 | 144.9 | 169.5 | 9 | 12 | 19 | 13 | 5.13 | 8 |
| 102 | 141.8 | 148.4 | 219 | 217 | 215 | 217 | 2.00 | 15 |
| 103 | 142.4 | 149.0 | 196 | 192 | 208 | 199 | 8.33 | 34 |
| 104 | 139.7 | 146.1 | 200 | 200 | 191 | 197 | 5.20 | 28 |
| 105 | 136.0 | 143.3 | 231 | 218 | 233 | 227 | 8.14 | 106 |
| 106 | 134.6 | 141.1 | 203 | 205 | 222 | 210 | 10.44 | 138 |
| 107 | 131.0 | 139.2 | 218 | 233 | 217 | 223 | 8.96 | 232 |
| 108 | 131.1 | 139.5 | 230 | 230 | 231 | 230 | 0.58 | 75 |
| 109 | 122.4 | 131.8 | 198 | 195 | 198 | 197 | 1.73 | 71 |
| 110 | 137.6 | 143.7 | 130 | 209 | 190 | 176 | 41.24 | 27 |
| 111 | 137.6 | 144.2 | 194 | 120 | 178 | 164 | 38.94 | 17 |
| 112 | 148.5 | 164.2 | 70 | 116 | 127 | 104 | 30.24 | 6 |
| 113 | 95.6 | 126.5 | 245 | 236 | 239 | 240 | 4.58 | 211 |

As shown in Table 7, the stainless steel pipes for oil wells labeled Test Nos. 102 to 108 exhibited yield strengths not lower than 125 ksi (862 MPa); for each of these pipes, the average value from the Charpy impact tests at −10° C. was not lower than 150 J, and the standard deviation was not higher than 15 J.

Further, in the stainless steel pipes for oil wells labeled Test Nos. 105 to 108, where the holding time for the second step was not shorter than 60 minutes, the average value from the Charpy impact tests at −60° C. was not lower than 50 J.

On the other hand, in the stainless steel pipe for oil wells labeled Test No. 101, the average value from the Charpy impact tests at −10° C. was lower than 150 J. This is presumably because the second step of the tempering was not performed. The stainless steel pipe for oil wells labeled Test No. 109 had a yield strength lower than 125 ksi. This is presumably because the first step of the tempering was not performed.

In the stainless steel pipe for oil wells labeled Test No. 110, the standard deviation for the Charpy impact tests at −10° C. was higher than 15 J. This is presumably because the temperature for the first step of the tempering was too low. In the stainless steel pipe for oil wells labeled Test No. 111, the standard deviation for the Charpy impact tests at −10° C. was higher than 15 J. This is presumably because the temperature for the first step of the tempering was too high.

In the stainless steel pipe for oil wells labeled Test No. 112, the average value from the Charpy impact tests at −10° C. was lower than 150 J, and the standard deviation was higher than 15 J. This is presumably because the holding temperature for the second step of the tempering was too low. The stainless steel pipe for oil wells labeled Test No. 113 had a yield strength lower than 125 ksi. This is presumably because the holding time for the second step of the tempering was too high.

The invention claimed is:

1. A stainless steel pipe for oil wells having a chemical composition of, in mass %:

up to 0.05% C;
up to 1.0% Si;
0.01 to 1.0% Mn;
up to 0.05% P;
below 0.002% S;
0.001 to 0.1% Al;
16.0 to 18.0% Cr;
3.0 to 5.5% Ni;
1.8 to 3.0% Mo;
1.0 to 3.5% Cu;
up to 0.05% N;
up to 0.05% O;
0 to 0.3% Ti;
0 to 0.3% Nb;
0 to 0.3% V;
0 to 2.0% W;
0 to 0.01% Ca;
0 to 0.01% B; and
the balance Fe and impurities, wherein the steel has a metal structure having:

an average retained-austenite ratio, $V_{\gamma AVE}$, of 2.5 to 15% in volume fraction and a standard deviation of retained-austenite ratio, $\sigma(\gamma)$, of 1.0 or below;

a volume fraction of ferrite phase of not lower than 10% and lower than 60%; and a volume fraction of martensite of not lower than 40%;

wherein $V\gamma_{AVE}$ and $\sigma(\gamma)$ are calculated as:

$$V_{\gamma AVE}=(V_{\gamma I}+V_{\gamma M}+V_{\gamma O})/3$$

$$\sigma(\gamma)=((V_{\gamma I}-V_{\gamma AVE})^2+(V_{\gamma M}-V_{\gamma AVE})^2+(V_{\gamma O}-V_{\gamma AVE})^2)/2)^{1/2}$$

wherein $V_{\gamma I}$ is a volume fraction of retained austenite on an inner surface of the steel pipe, $V_{\gamma M}$ is a volume fraction of retained austenite in a middle section as determined along a wall thickness of the steel pipe, and $V_{\gamma O}$ is a volume fraction of retained austenite on an outer surface of the steel pipe.

2. The stainless steel pipe for oil wells according to claim 1, wherein an average amount of absorbed energy in a Charpy impact test at 10° C. is not lower than 150 J, with a standard deviation not higher than 15 J.

3. The stainless steel pipe for oil wells according to claim 1, wherein an average amount of absorbed energy in a Charpy impact test at −60° C. is not lower than 50 J.

4. The stainless steel pipe for oil wells according to claim 1, wherein the chemical composition contains one or more elements selected from the group consisting of, in mass %:

0.005 to 0.3% Ti;

0.005 to 0.3% Nb; and 0.005 to 0.3% V.

5. The stainless steel pipe for oil wells according to claim 1, wherein the chemical composition contains, in mass %:

0.01 to 2.0% W.

6. The stainless steel pipe for oil wells according to claim 1, wherein the chemical composition contains one or both elements selected from the group consisting of, in mass %:

0.0002 to 0.01% Ca; and 0.0002 to 0.01% B.

7. The stainless steel pipe for oil wells according to claim 1, wherein a yield strength is not lower than 862 MPa.

8. A method of manufacturing the stainless steel pipe for oil wells of claim 1 comprising:

the step of preparing a hollow shell having a chemical composition of, in mass %: up to 0.05% C; up to 1.0% Si; 0.01 to 1.0% Mn; up to 0.05% P; below 0.002% S; 0.001 to 0.1% Al; 16.0 to 18.0% Cr; 3.0 to 5.5% Ni; 1.8 to 3.0% Mo; 1.0 to 3.5% Cu; up to 0.05% N; up to 0.05% 0; 0 to 0.3% Ti; 0 to 0.3% Nb; 0 to 0.3% V; 0 to 2.0% W; 0 to 0.01% Ca; 0 to 0.01% B; and the balance Fe and impurities;

a first step for holding the hollow shell in a temperature range of 420 to 460° C. for a holding time of 60 to 180 minutes; and a second step, after the first step, for holding the hollow shell in a temperature range of 550 to 600° C. for a holding time of 5 to 300 minutes.

9. The method of manufacturing a stainless steel pipe for oil wells according to claim 8, wherein the holding time for the second step is 60 to 300 minutes.

10. The method of manufacturing a stainless steel pipe for oil wells according to claim 8, wherein the chemical composition contains one or more elements selected from the group consisting of, in mass %:

0.005 to 0.3% Ti;

0.005 to 0.3% Nb; and 0.005 to 0.3% V.

11. The method of manufacturing a stainless steel pipe for oil wells according to claim 8, wherein the chemical composition contains, in mass %:

0.01 to 2.0% W.

12. The method of manufacturing a stainless steel pipe for oil wells according to claim 8, wherein the chemical composition contains one or both elements selected from the group consisting of, in mass %:

0.0002 to 0.01% Ca; and 0.0002 to 0.01% B.

* * * * *